US009010283B2

(12) United States Patent
Nagata et al.

(10) Patent No.: US 9,010,283 B2
(45) Date of Patent: Apr. 21, 2015

(54) STRUCTURE FOR DISCHARGING WATER FROM COOLING WATER PUMP IN VEHICLE ENGINE

(75) Inventors: Yuki Nagata, Wako (JP); Yusuke Tomioka, Wako (JP); Takashi Sunaga, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 598 days.

(21) Appl. No.: 13/432,848

(22) Filed: Mar. 28, 2012

(65) Prior Publication Data

US 2012/0247409 A1 Oct. 4, 2012

(30) Foreign Application Priority Data

Mar. 31, 2011 (JP) ..... 2011-080662

(51) Int. Cl.

| | |
|---|---|
| ***F01P 5/10*** | (2006.01) |
| ***F02F 1/10*** | (2006.01) |
| ***F01P 3/02*** | (2006.01) |
| ***F01P 11/04*** | (2006.01) |

(52) U.S. Cl.
CPC .. *F01P 3/02* (2013.01); *F01P 11/04* (2013.01)

(58) Field of Classification Search
USPC ..... 123/41.01, 41.44
See application file for complete search history.

(56) References Cited

U.S. PATENT DOCUMENTS

| | | | |
|---|---|---|---|
| 5,282,446 | A | 2/1994 | Whitefield |
| 5,338,153 | A | 8/1994 | Swanson et al. |
| 5,355,847 | A | 10/1994 | Ozeki |

FOREIGN PATENT DOCUMENTS

| | | | |
|---|---|---|---|
| DE | 4119131 | A1 | 12/1992 |
| DE | 69900150 | T2 | 10/2001 |
| EP | 0987174 | A1 | 3/2000 |
| JP | 4-116297 | A | 4/1992 |
| JP | 2002-115546 | A | 4/2002 |
| JP | 2004-301097 | A | 10/2004 |
| JP | 3867841 | B2 | 10/2006 |

*Primary Examiner* — Noah Kamen
(74) *Attorney, Agent, or Firm* — Birch, Stewart, Kolasch & Birch, LLP

(57) ABSTRACT

While enlargement of cover members attached to an engine body is avoided, the flexibility of the shapes of the cover members is increased and it is made possible to lead to a predetermined position drainage discharged from a cooling water pump attached to the external surface of a lateral wall of the engine body. A drainage discharge hole for discharging drainage is provided in a lower portion of a pump case. An engine side rib leads downward drainage discharged from the drainage discharge hole is integrally provided on an engine body forming part of the engine body so as to project from an external surface of a lateral surface thereof.

20 Claims, 6 Drawing Sheets

STRUCTURE FOR DISCHARGING WATER FROM COOLING WATER PUMP IN VEHICLE ENGINE

CROSS-REFERENCE TO RELATED APPLICATIONS

The present application claims priority under 35 USC 119 to Japanese Patent Application No. 2011-080662 filed Mar. 31, 2011 the entire contents of which are hereby incorporated by reference.

BACKGROUND OF THE INVENTION

1. Field of the Invention

The present invention relates to a vehicle engine in which a pump case for a cooling water pump adapted to circulate cooling water in an engine body is mounted to an external surface of a lateral wall of the engine body. In particular, the invention relates to an improvement in a structure for discharging water from the cooling water pump.

2. Description of Background Art

A vehicle V-type engine as below is known. See, for example, Japanese Patent No. 3867841. A drainage discharge path is formed by a clutch cover attached to a cylinder block and a pump cover with water collecting in V-banks is discharged from the drainage discharge path.

Drainage is discharged also from a cooling water pump mounted on an external surface of a lateral wall of an engine body. If the configuration disclosed in Japanese Patent No. 3867841 is applied in order to lead such drainage to a given position, the shapes of cover members are limited because of the configuration of the drainage discharge path. Therefore, the cover members are likely to be enlarged depending on the length of the drainage discharge path.

The present invention has been made in view of such situations and aims to provide a structure for discharging water from a cooling water pump in a vehicle engine, in which while enlargement of cover members attached to an engine body is avoided, the flexibility of the shapes of the cover members is increased and it is made possible to lead drainage discharged from a cooling water pump to a predetermined position.

SUMMARY AND OBJECTS OF THE INVENTION

To achieve the above object, an embodiment of the present invention provides a structure for discharging water from an cooling water pump in a vehicle engine in which a pump case for a cooling water pump adapted to circulate cooling water in an engine body is mounted on an external surface of a lateral wall of the engine body. A drainage discharge hole for discharging drainage is provided in a lower portion of the pump case with an engine side rib being integrally provided on an engine body constituting part of the engine body so as to project from an external surface of a lateral surface of the engine body. The engine side rib is adapted to lead downward drainage discharged from the drainage discharge hole.

According to an embodiment of the present invention, in a state where the engine body is mounted on a vehicle, the engine side rib is disposed rearward of the drainage discharge hole with a pump side rib facing the engine side rib from the rear being provided in the pump case formed to cover the engine side rib.

According to an embodiment of the present invention, a second engine rib located behind the engine side rib is integrally provided on the engine body to project from an external surface of the lateral surface of the engine body.

According to an embodiment of the present invention, in the state where the engine body is mounted on the vehicle, windshield ribs located in front of the drainage discharge hole are provided on at least one of the engine body and the pump case so as to project therefrom.

According to an embodiment of the present invention, the windshield ribs are provided on both the engine body and the pump case.

According to an embodiment of the present invention, the engine side ribs are formed to extend from the lateral wall to a front wall of the engine body.

According to an embodiment of the present invention, the engine side rib is formed integrally continuously with a bolt-fastening boss provided on the engine body.

According to an embodiment of the present invention, in the state where the engine body is mounted on the vehicle, the windshield rib located in front of the drainage discharge hole is provided on the engine body so as to be integrally continuous with the boss.

In addition, the cylinder head 14 of the present embodiment corresponds to the engine body of the present invention.

According to an embodiment of the present invention, drainage discharged from the drainage discharge hole provided in the lower portion of the pump case is led downward by the engine side rib. The engine side rib is integrally provided on the engine body constituting part of the engine body so as to project from the external surface of the lateral surface of the engine body. Therefore, it is not necessary to configure a drainage discharge path by means of cover members. The flexibility of the shapes of the cover members can be increased and the enlargement of the cover members can be avoided. Thus, the simplification of the discharge path structure for leading the drainage discharged from the cooling water pump can be achieved.

According to an embodiment of the present invention, the pump case is formed to cover the engine side rib disposed rearward of the drainage discharge hole with the pump side rib facing the engine side rib from the rear being provided on the pump case. Therefore, a labyrinth structure is configured between the engine body and the pump case. Drainage discharged from the drainage discharge hole is covered by the pump case to achieve an improvement in external appearance. In addition, an influence of a flow of air can be reduced, so that the drainage can surely be guided in a predetermined direction.

According to an embodiment of the present invention, the two engine side ribs ranged back and forth are provided on the engine body. Therefore, even if drainage climbs over the front engine side rib, it is led downward along the rear engine side rib. Thus, it is possible to prevent the drainage discharged from the drainage discharge hole, from flowing rearward along the external surface of the lateral wall of the engine body.

According to an embodiment of the present invention, the windshield ribs located in front of the drainage discharge hole are provided on at least one of the engine body and the pump case so as to project therefrom. Therefore, the influence of a flow of air on the drainage discharge hole can be reduced to enhance the drainage performance.

According to an embodiment of the present invention, the windshield ribs are provided on both the engine body and the pump case so as to project therefrom. Therefore, the influence of a flow of air on the drainage discharge hole can be more reduced.

According to an embodiment of the present invention, the engine side ribs extend from the lateral wall to front wall of the engine body. Therefore, the drainage flowing on the lateral wall of the engine body to the lower end thereof is allowed to flow along the front wall side of the engine body. In this way, it is possible to prevent the drainage from dropping from the lateral wall of the engine body.

According to an embodiment of the present invention, the engine side rib is integrally continuous with the bolt-fastening boss provided on the engine body. Therefore, the engine side rib can achieve a function of reinforcing the boss.

According to an embodiment of the present invention, the windshield rib is integrally continuous with the boss. Therefore, the two ribs are made integrally continuous with the boss, thereby making it possible to further reinforce the boss.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
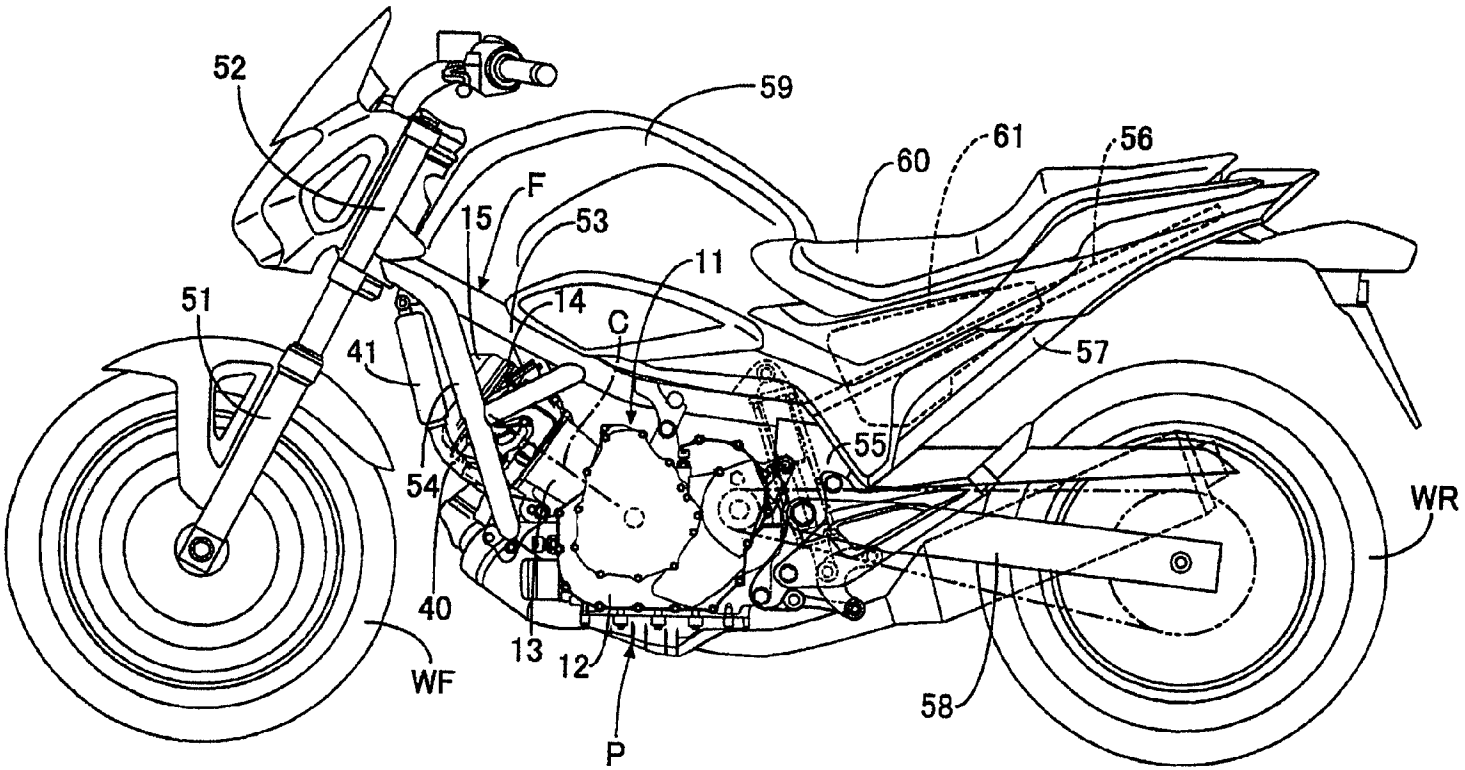
FIG. 1 is a lateral view of a motorcycle.

Embodiments of the present invention will be described with reference to the accompanying FIGS. 1 to 7. Referring first to FIG. 1, a body frame F of a motorcycle includes a head pipe 52 steerably supporting a front fork 51 rotatably supporting a front wheel WF; a pair of left and right main frames 53 extending rearward downward from the head pipe 53; and a pair of left and right down frames 54 extending rearward downward from the head pipe 52 more steeply-inclined than the main frames 53. The body frame F further includes a pair of left and right center frames 55 extending downward from the corresponding rear ends of the main frames 53; a pair of left and right seat rails extending rearward upward from the corresponding upper portions of the center frames 55; and rear frames 57 each connecting an intermediate portion of the center frame 55 with a rear portion of the seat rail 56.

Figure 2:
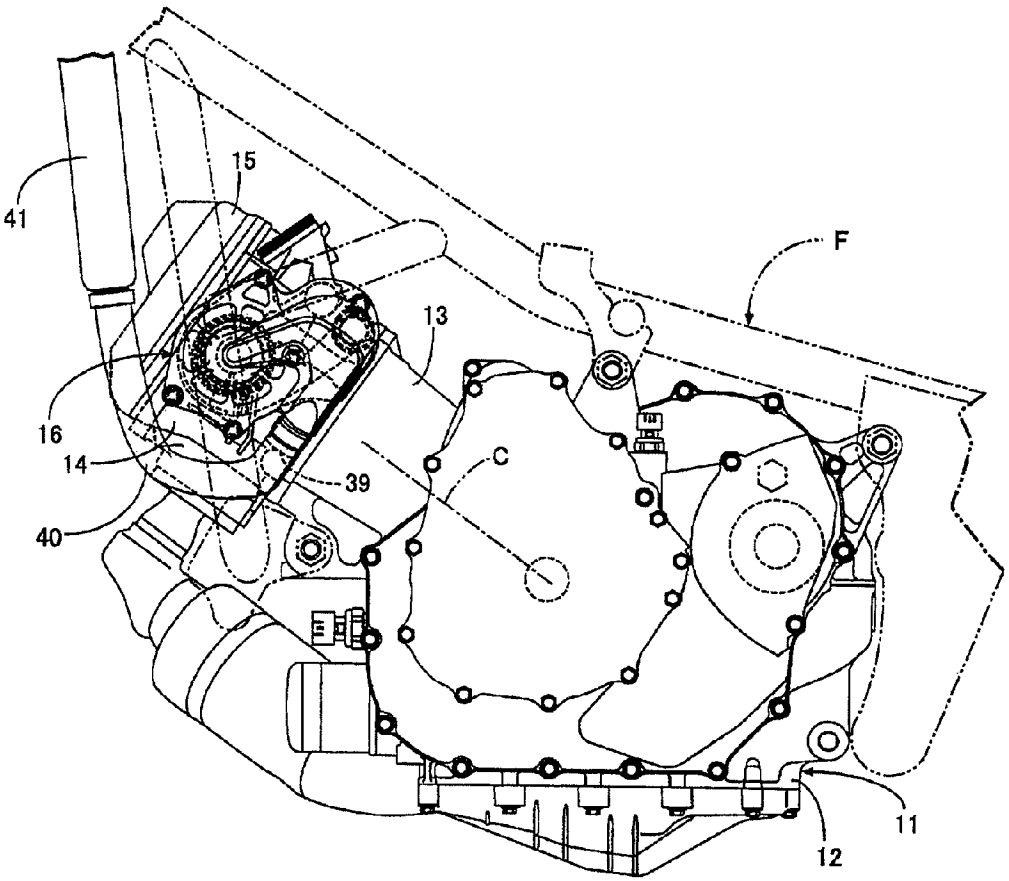
FIG. 2 is an enlarged view of an essential portion in FIG. 1.

With additional reference to FIG. 2, an engine body 11 of a multi-cylinder, e.g., a two-cylinder engine is mounted in an area surrounded by the main frames 53, the down frames 54 and the center frames 55. A power unit P is disposed so as to be supported by the body frame F. The power unit P includes an engine and a transmission (not shown) partially incorporated in the engine body 11. A swing arm 58 rotatably supports at a rear end a rear wheel WR driven by power outputted from the power unit P. The swing arm 58 is vertically swingably supported at a front end by the center frames 55. A storage box 59 is mounted on the main frames 53 at a position above the engine body 11. A tandem-type riding seat 60 is disposed behind the storage box 59 so as to be supported by the seat rails 56. A fuel tank 61 is disposed below the riding seat 60.

The engine body 11 includes a crankcase 12; a cylinder block 13 joined to a front upper portion of the crankcase 12 with a cylinder axis C inclined forward upward; a cylinder head 14 joined to the cylinder block 13; and a head cover 15 joined to the cylinder head 14.

Figure 3:
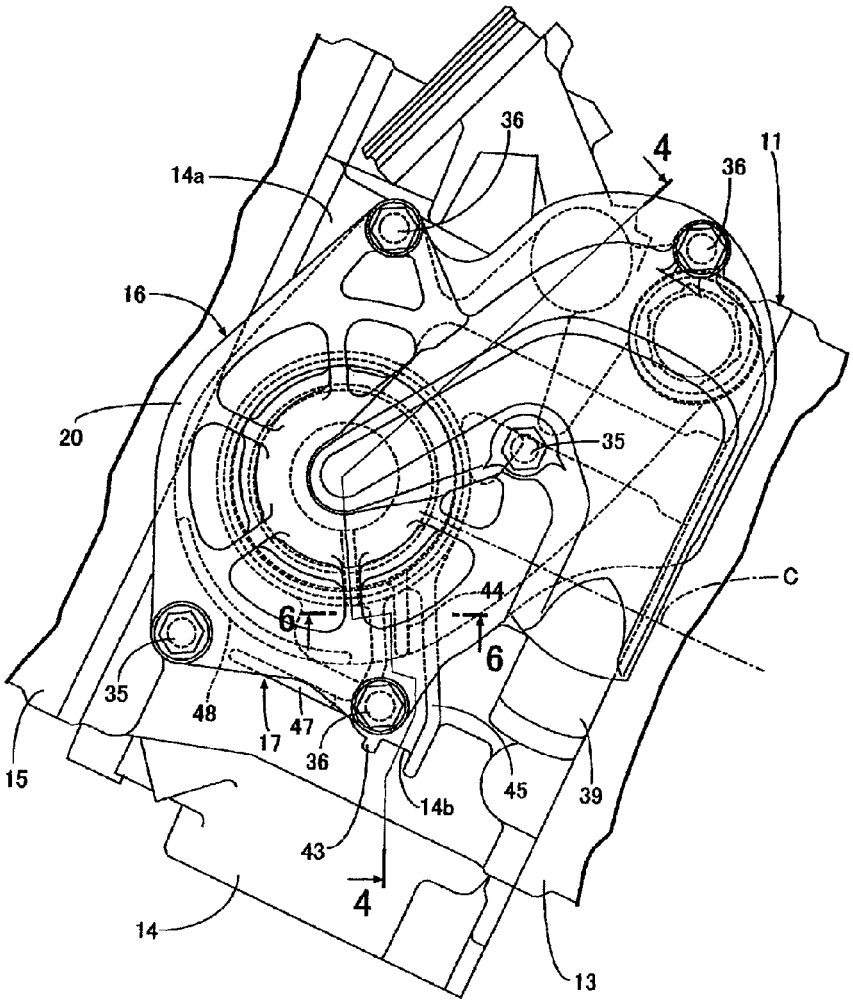
FIG. 3 is an enlarged view of an essential portion of an engine.
Figure 4:
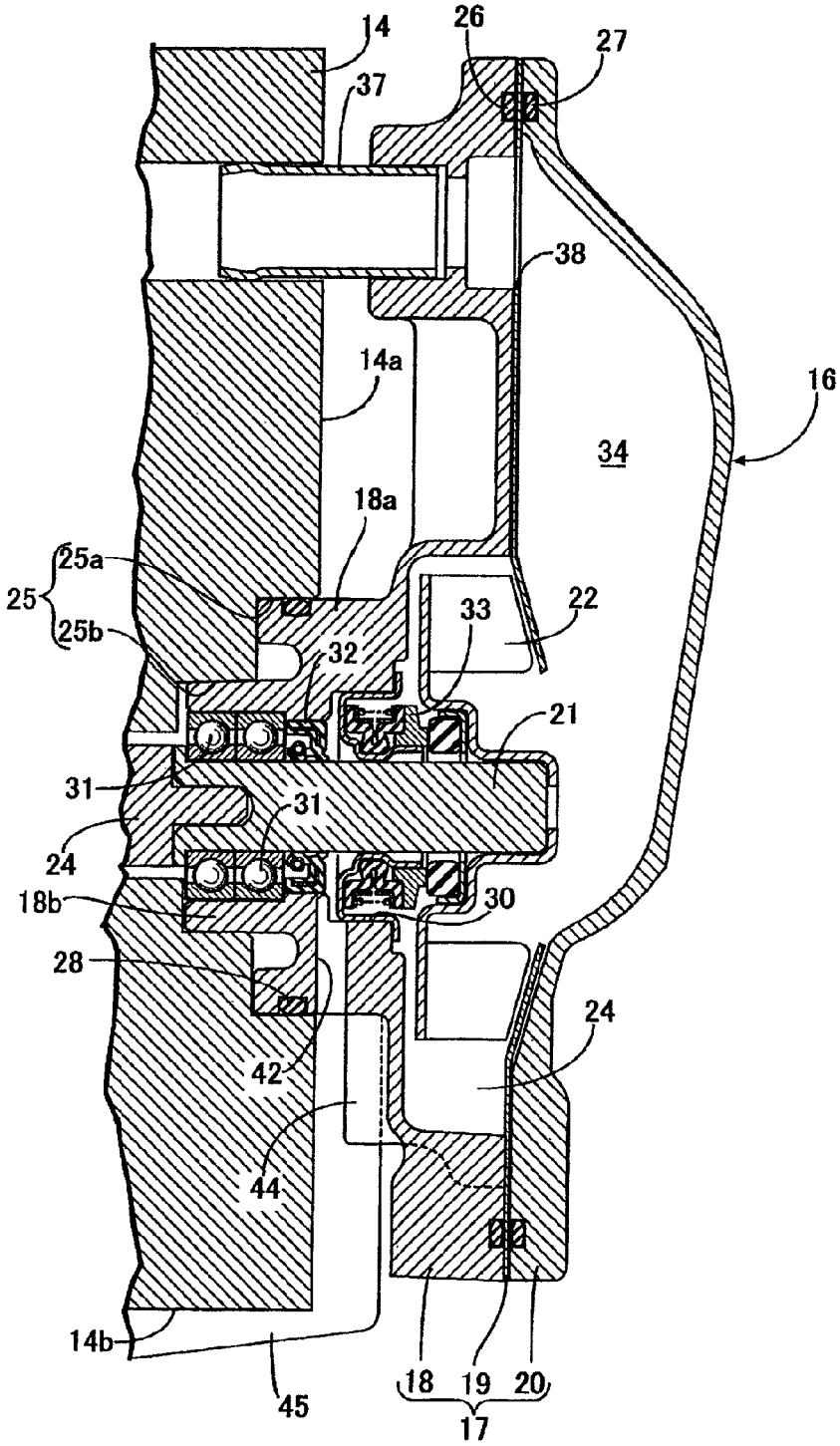
FIG. 4 is a cross-sectional view taken along line 4-4 in FIG. 3.

With additional reference to FIGS. 3 and 4, a pump case 17 for a cooling water pump 16 is mounted to an external surface of a left lateral wall 14*a* of both left and right lateral surfaces of the cylinder head 14. The cylinder head 14 is an engine body constituting part of the engine body 11. The cooling-water pump 16 is adapted to circulate cooling water in the cylinder block 13 and cylinder head 14 of the engine body 11.

The cooling water pump 16 includes a pump case 17, a pump shaft 21 and an impeller 22. The pump shaft 21 is rotatably supported by the pump case 17 so as to be connected for relative non-rotation to the cam shaft 24 disposed on the side of the cylinder head 14. The impeller 22 is secured to the pump shaft 21.

Figure 5:
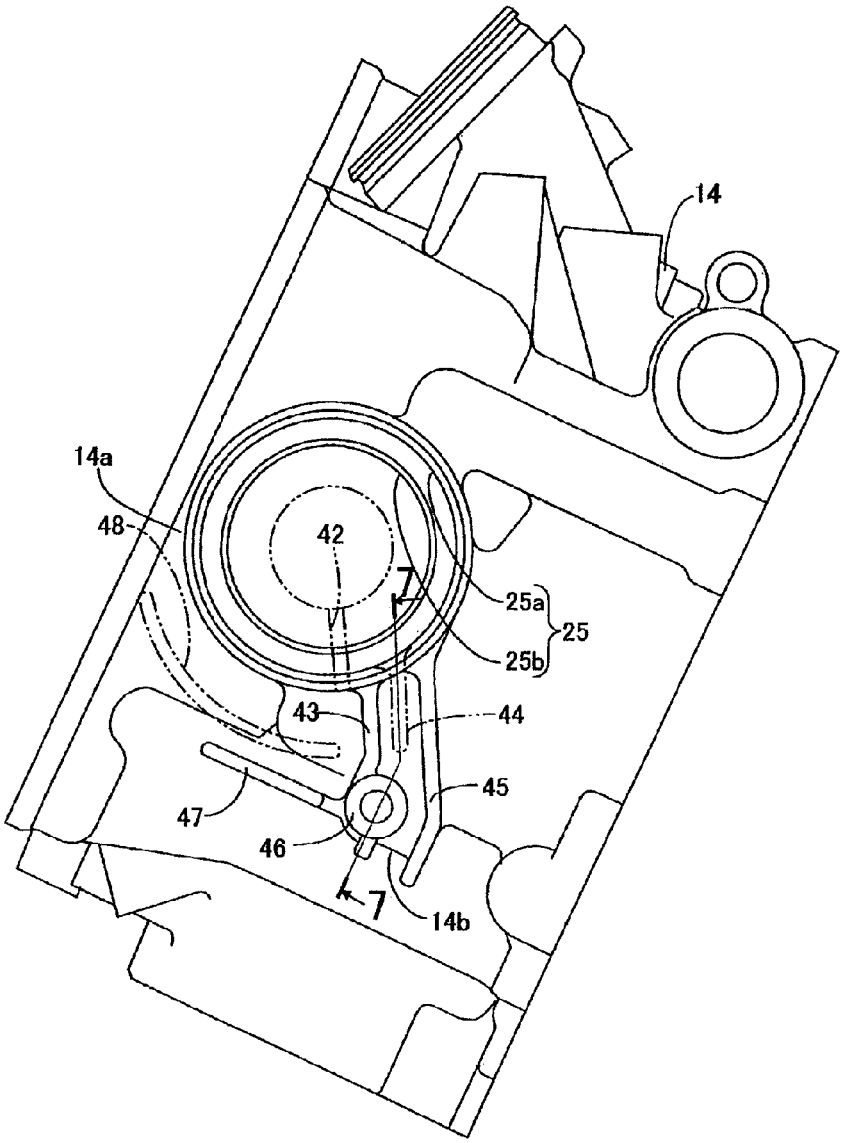
FIG. 5 is a lateral view of a cylinder head as viewed from the same direction as in FIG. 3, with a cooling water pump removed.

With additional reference to FIG. 5, a pump-mounting hole 25 opening in an external surface of the left lateral wall 14*a* of the cylinder head 14 is provided to face one end portion of the camshaft 24. The pump-mounting hole 25 is composed of a large-diameter hole portion 25*a* and a small-diameter hole portion 25*b*. The large-diameter hole portion 25*a* has one end opening in the external surface of the left lateral wall 14*a* of the cylinder head 14. The small-diameter hole portion 25*b* is formed to have a diameter smaller than that of the large-diameter hole portion 25*a* and to have one end coaxially continuous with the other end of the large-diameter hole portion 25*a*.

On the other hand, the pump case 17 includes a case main body 18; a plate 19 defining a pump chamber 23 between the case main body 18 and the plate 19; and a pump cover 20 holding the plate 19 between the case main body 18 and the pump cover 20. An annular seal member 26 is interposed between the case main body 18 and the plate 19 and an annular seal member 27 is interposed between the pump cover 20 and the plate 19.

The case main body 18 is provided integrally with a large-diameter shaft portion 18*a* and a small-diameter shaft portion 18*b*. The large-diameter shaft portion 18*a* is fitted into the large-diameter hole portion of the pump-mounting hole 25 via the annular seal member 28. The small-diameter shaft portion 18*b* coaxially projects from the large-diameter portion 18*a* and is fitted into the small-diameter portion 25*b* of pump-mounting hole 25. The large-diameter shaft portion 18*a* and the small-diameter shaft portion 18*b* have a central hole 30 adapted to receive the pump shaft 21 inserted therethrough.

A pair of ball bearings 31, 31 is interposed between the outer circumference of the pump shaft 21 and the inner circumference of the central hole 30. An annular oil seal 32 and a mechanical seal 33 are interposed inside the ball bearings 31 and between the outer circumference of the pump shaft 21 and the inner circumference of the central hole 30.

The impeller 22 is secured to the pump shaft 21 in the pump chamber 23. A suction chamber 34 communicating with the central portion of the pump chamber 23 is defined between the pump cover 20 and the plate 19.

In this way, the case main body 18, the plate 19 and the pump cover 20 are joined together by means of e.g. two bolts 35, 35 to constitute the pump case 17. The pump case 17 is fastened to the cylinder head 14 by means of e.g. three bolts 36, 36, 36.

In addition, a connection pipe 37 is liquid-tightly fitted at both end portions into the case main body 18 and the cylinder head 14. The connection pipe 37 communicates with a jacket (not shown) formed inside the cylinder head 4. Cooling water led through the connection pipe 37 is led into the suction chamber 34 via a communication hole 38 provided in the plate 19. On the other hand, a discharge pipe 39 adapted to lead the cooling water discharged from the cooling water pump 16 is installed on the pump cover 20 to communicate with the pump chamber 23. As shown in FIGS. 1 and 2, a pipe line 40 continuous with the discharge pipe 39 is connected to a radiator 41 fixedly disposed forward of the engine body 11.

Figure 6:
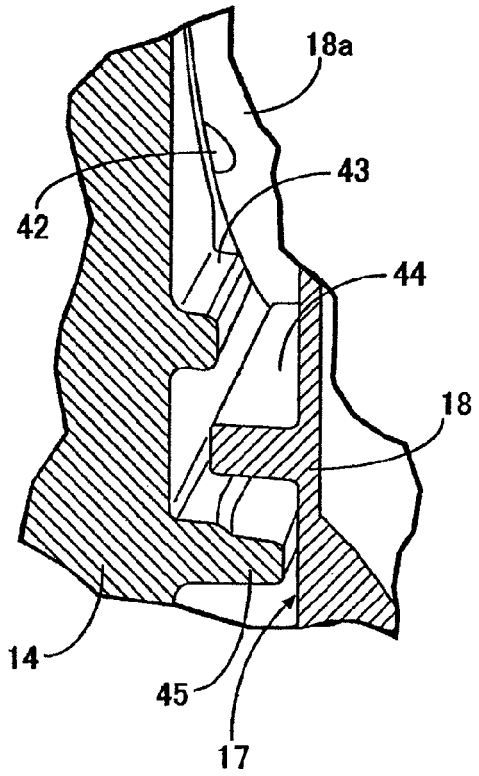
FIG. 6 is a cross-sectional view taken along line 6-6 in FIG. 3.

With additional reference to FIG. 6, a drainage discharge hole 42 is provided at a lower part of a portion, projecting from the pump-mounting hole 25 of the cylinder head 14, of the large-diameter shaft portion 18*a* of the pump case 17 so as to have an external end opening in the external surface of the large-diameter shaft portion 18*a*. The drainage discharge hole 42 has an inner end communicating with the central hole 30 at a position between the oil seal 32 and the mechanical seal 33. A first engine side rib 43 vertically extends to lead downward the drainage discharged from the drainage discharge hole 42. The first engine side rib 43 is integrally provided to project from the external surface of the left lateral wall 14*a* of the cylinder head 14.

In addition, the first engine side rib 43 is disposed behind the drainage discharge hole 42 in the state where the engine body 11 is mounted on the motorcycle. The pump case 17 of the cooling water pump 16 is formed to cover the first engine side rib 43. Further, a pump side rib 44 is integrally provided on the case main body 18 of the pump case 17 so as to extend vertically and to face the first engine side rib 43 from the back.

A second engine side rib 45 is integrally provided on the external surface of the left lateral wall 14*a* of the cylinder head 14 so as to project therefrom and extend vertically. In addition, the second engine side rib 45 is located behind the first engine side rib 43. The pump side rib 44 is disposed between the first and second engine side ribs 43 and 45.

Figure 7:
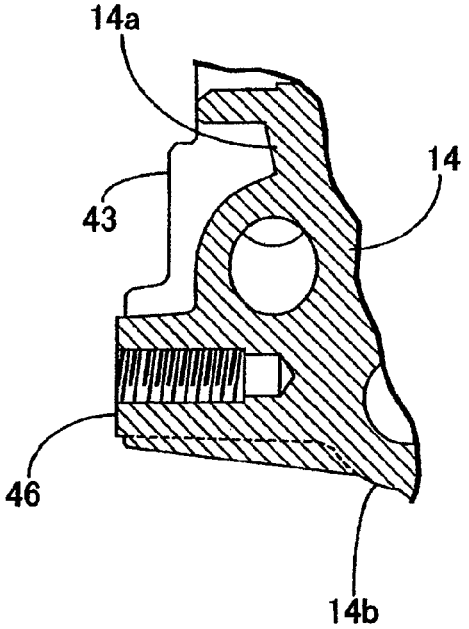
FIG. 7 is a cross-sectional view taken along line 7-7 in FIG. 5.

As shown in FIG. 7, the first engine side rib 43 is formed to extend from the left lateral wall 14*a* to a front wall 14*b* of the cylinder head 14. As shown in FIG. 4, the second engine side rib 45 is formed to extend from the left lateral wall 14*a* to front wall 14*b* of the cylinder head 14.

The first engine side rib 43 is formed integrally continuously with a bolt-fastening boss 46. This boss 46 is provided to project from the lower external surface of the left lateral wall 14*a* of the cylinder head 14. The boss 46 is used to fasten one of three bolts 36 for fastening the pump case 17 to the cylinder head 14.

In the state where the engine body 11 is mounted on the motorcycle, windshield ribs 47 and 48 located in front of the drainage discharge hole 42 are provided on at least one of the cylinder head 14 and the pump case 17 so as to project therefrom. In the present embodiment, the windshield ribs 47 and 48 are provided on both of the cylinder head 14 and the pump case 17 to project therefrom. The windshield rib 47 provided to project from the external surface of the left lateral wall 14*a* of the cylinder head 14 extends in the back and forth direction and is formed integrally continuously with the boss 46. The windshield rib 48 provided to project from the case main body 18 of the pump case 17 is circularly formed to bulge toward the front.

A description is next given of the function of the present embodiment. The drainage discharge hole 42 for discharging drainage is provided at the lower portion of the pump case 17 provided for the cooling water pump 16. In addition, the first engine side rib 43 for leading downward drainage discharged from the drainage discharge hole 42 is integrally provided on the cylinder head 14 so as to project from the external surface of the left lateral surface 14*a* thereof. Therefore, it is not necessary to allow a plurality of cover members to configure a drainage discharge path. It is possible to increase the flexibility of the shapes of cover members mounted to the engine body 11 and to avoid the enlargement of the cover members. Thus, it is possible to achieve a simplification of a drainage discharge path structure adapted to lead drainage discharged from the cooling water pump 16.

In the state where the engine body 11 is mounted on the motorcycle, the first engine side rib 43 is disposed rearward of the drainage discharge hole 42. In addition, the pump case 17 formed to cover the first engine side rib 43 has the pump side rib 44 facing the first engine side rib 43 from the rear. In this way, a labyrinth structure is configured between the cylinder head 14 and the pump case 17. The drainage discharged from the drainage discharge hole 42 is covered by the pump case 17 to improve external appearance. In addition, drainage can be ensured to be guided in a predetermined direction while reducing an influence of a flow of air.

The second engine side rib 45 located rearward of the first engine side rib 43 is integrally provided on the cylinder head 14 to project from the external surface of the left lateral wall 14*a* thereof. Therefore, even if drainage climbs over the first engine side rib 43 located on the front side, it is led downward along the second engine side rib 45 located on the rear side. Thus, it is possible to suppress the flow of drainage discharged from the drainage discharge hole 42 along the external surface of the lateral wall of the engine body 11.

In the state where the engine body 11 is mounted on the motorcycle, the windshield ribs 47 and 48 located forward of the drainage discharge hole 42 are provided on at least one of the cylinder head 14 and the pump case 17 to project therefrom. Therefore, it is possible to reduce the influence of a flow, of air on the drainage discharge hole 42, thereby enhancing the drainage performance. In particular, since the windshield ribs 47 and 48 are provided for both the cylinder head 14 and the pump case 17, it is possible to further reduce the influence of the flow of air on the drainage discharge hole 42.

The first and second engine side ribs 43 and 45 are formed to extend from the left lateral wall 14*a* to a front wall 14*b* of the cylinder head 14. Therefore, the drainage flowing along the lateral wall 14*a* of the cylinder head 14 to the lower end thereof is allowed to flow to the front wall 14*b* side of the cylinder head 14. Thus, it is possible to prevent the drainage from dropping from the lateral wall of the cylinder head 14.

The first engine side rib 43 is formed integrally continuously with the bolt-fastening boss 46 provided on the cylinder head 14. Therefore, the first engine side rib 43 can achieve a function of reinforcing the boss 46. Further, the windshield rib 47 installed on the cylinder head 14 at a position in front of the drainage discharge hole 42 is integrally continuous with the boss 56. Therefore, the two ribs 43 and 47 are made integrally continuous with the boss 46 to further reinforce the boss 46.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A structure for discharging water from a cooling water pump in a vehicle engine in which a pump case for a cooling water pump adapted to circulate cooling water in an engine body is mounted on an external surface of a lateral wall of the engine body, comprising:

a drainage discharge hole for discharging drainage, said drainage discharge hole being provided in a lower portion of the pump case; and an engine side rib integrally provided on an engine body forming part of the engine body so as to project from an external surface of a lateral surface of the engine body, wherein said engine side rib is adapted to lead downward drainage discharged from the drainage discharge hole.

2. The structure for discharging water from a cooling water pump in a vehicle engine according to claim 1, wherein in a state where the engine body is mounted on a vehicle, the engine side rib is disposed rearward of the drainage discharge hole, and a pump side rib facing the engine side rib from the rear is provided on the pump case formed to cover the engine side rib.

3. The structure for discharging water from a cooling water pump in a vehicle engine according to claim 2, wherein a second engine rib located behind the engine side rib is integrally provided on the engine body to project from an external surface of the lateral surface of the engine body.

4. The structure for discharging water from a cooling water pump in a vehicle engine according to claim 3, wherein in the state where the engine body is mounted on the vehicle, windshield ribs located in front of the drainage discharge hole are provided on at least one of the engine body and the pump case to project therefrom.

5. The structure for discharging water from a cooling water pump in a vehicle engine according to claim 3, wherein the engine side ribs are formed to extend from the lateral wall to a front wall of the engine body.

6. The structure for discharging water from a cooling water pump in a vehicle engine according to claim 2, wherein in the state where the engine body is mounted on the vehicle, windshield ribs located in front of the drainage discharge hole are provided on at least one of the engine body and the pump case to project therefrom.

7. The structure for discharging water from a cooling water pump in a vehicle engine according to claim 2, wherein the engine side ribs are formed to extend from the lateral wall to a front wall of the engine body.

8. The structure for discharging water from a cooling water pump in a vehicle engine according to claim 2, wherein the engine side rib is formed integrally continuously with a bolt-fastening boss provided on the engine body.

9. The structure for discharging water from a cooling water pump in a vehicle engine according to claim 1, wherein in a state where the engine body is mounted on the vehicle, windshield ribs located in front of the drainage discharge hole are provided on at least one of the engine body and the pump case to project therefrom.

10. The structure for discharging water from a cooling water pump in a vehicle engine according to claim 9, wherein the windshield ribs are provided on both the engine body and the pump case.

11. The structure for discharging water from a cooling water pump in a vehicle engine according to claim 1, wherein the engine side ribs are formed to extend from the lateral wall to a front wall of the engine body.

12. The structure for discharging water from a cooling water pump in a vehicle engine according to claim 1, wherein the engine side rib is formed integrally continuously with a bolt-fastening boss provided on the engine body.

13. The structure for discharging water from a cooling water pump in a vehicle engine according to claim 12, wherein in a state where the engine body is mounted on the vehicle, the windshield rib located in front of the drainage discharge hole is provided on the engine body so as to be integrally continuous with the boss.

14. A drainage structure for discharging water from a pump case, comprising:

a drainage discharge hole for discharging drainage, said drainage discharge hole being provided in a lower portion of the pump case; and an engine side rib integrally provided on an engine body forming part of the engine body, said engine rib projecting from an external surface of a lateral surface of the engine body;

wherein said engine side rib leads downwardly drainage discharged from the drainage discharge hole to discharge drainage from the pump case.

15. The drainage structure for discharging water from a pump case according to claim 14, wherein in a state where the engine body is mounted on a vehicle, the engine side rib is disposed rearward of the drainage discharge hole, and a pump side rib facing the engine side rib from the rear is provided on the pump case formed to cover the engine side rib.

16. The drainage structure for discharging water from a pump case according to claim 15, wherein a second engine rib located behind the engine side rib is integrally provided on the engine body to project from an external surface of the lateral surface of the engine body.

17. The drainage structure for discharging water from a pump case according to claim 15, wherein in the state where the engine body is mounted on the vehicle, windshield ribs located in front of the drainage discharge hole are provided on at least one of the engine body and the pump case to project therefrom.

18. The drainage structure for discharging water from a pump case according to claim 14, wherein in a state where the engine body is mounted on the vehicle, windshield ribs located in front of the drainage discharge hole are provided on at least one of the engine body and the pump case to project therefrom.

19. The drainage structure for discharging water from a pump case according to claim 18, wherein the windshield ribs are provided on both the engine body and the pump case.

20. The drainage structure for discharging water from a pump case according to claim 14, wherein the engine side ribs are formed to extend from the lateral wall to a front wall of the engine body.

* * * * *